US006805085B2

(12) United States Patent
Kuhl et al.

(10) Patent No.: US 6,805,085 B2
(45) Date of Patent: Oct. 19, 2004

(54) HYDRAULIC SYSTEM FOR AN INTERNAL COMBUSTION ENGINE

(75) Inventors: Mario Kuhl, Herzogenaurach (DE); Henning Karbstein, Strullendorf (DE); Lothar von Schimonsky, Nuremberg (DE)

(73) Assignee: INA-Schaeffler KG, Herzogenaurach (DE)

( * ) Notice: Subject to any disclaimer, the term of this patent is extended or adjusted under 35 U.S.C. 154(b) by 353 days.

(21) Appl. No.: 10/126,174

(22) Filed: Apr. 19, 2002

(65) Prior Publication Data

US 2003/0005897 A1 Jan. 9, 2003

(30) Foreign Application Priority Data

Apr. 20, 2001 (DE) ..... 101 19 366

(51) Int. Cl.[7] ..... F01L 1/14

(52) U.S. Cl. ..... 123/90.57; 123/90.48; 123/90.59

(58) Field of Search ..... 123/90.48, 90.49, 123/90.52, 90.55, 90.56, 90.57, 90.58, 90.59

(56) References Cited

U.S. PATENT DOCUMENTS

| | | | | |
|---|---|---|---|---|
| 4,800,850 A | | 1/1989 | Yoshida et al. | |
| 5,372,114 A | * | 12/1994 | Gant et al. | 123/502 |
| 5,857,438 A | * | 1/1999 | Barnard | 123/90.16 |

FOREIGN PATENT DOCUMENTS

| | | |
|---|---|---|
| DE | 3738488 | 7/1988 |
| DE | 19741918 | 3/1998 |

* cited by examiner

*Primary Examiner*—Thomas Denion
*Assistant Examiner*—Jaime Corrigan
(74) *Attorney, Agent, or Firm*—Volpe and Koenig, P.C.

(57) ABSTRACT

A hydraulic system (1) for a switchable valve drive element (10) of an internal combustion engine (33) is provided and includes a throttled connection (13) created from a second channel (9), used to actuate a hydraulic play-compensation element (11) using hydraulic fluid, directly to an external radial side (12) of a coupling element (8). The coupling element (8) is supplied by a first channel (7) with the switching hydraulic pressure. These measures make it possible to keep the first channel (7) as free as possible of undesired air.

8 Claims, 2 Drawing Sheets

10, 25
10, 14
29
26
9
27
35
13
12
33
7
8
36
28
11
31, 32
30
24
17
18
19
15
20
16
23
21, 24
22

HYDRAULIC SYSTEM FOR AN INTERNAL COMBUSTION ENGINE

BACKGROUND

This invention relates to a hydraulic system for an internal combustion engine with at least one hydraulically actuated coupling element such as a sliding coupling, preferably in a switchable valve drive element such as a cam follower or support element for it. The valve drive element is preferably of the type having at least two parts that move with respect to one another to attain different cam strokes, wherein on at least one side of the coupling element, a path runs in or on the valve drive element to feed switching hydraulic fluid pressure. The valve drive element moves within a bore in the internal combustion engine into which a first channel opens to feed the switching hydraulic fluid pressure, one end of the channel being supplied by a hydraulic fluid pump followed by a directional valve to turn on and turn off the switching pressure, and the other end of the channel being hydraulically connected to the path.

Hydraulic systems of this type in an internal combustion engine, for example to actuate a coupling element of a switchable valve drive element such as a flat tappet, roller tappet, support element or finger lever or rocker arm or the like, exhibit a list of system-dependent disadvantages (see also DE 196 04 866 or U.S. Pat. No. 5,351,662). When a switch command is issued, delays or fluctuations in the switching time occur that are dependent on RPM, temperature, wear, tolerances or oil viscosity. An important factor influencing the delay in the switching time is the undesirable high compressibility of the hydraulic fluid used caused by entrained air bubbles or oil foaming that occurs on top of the inherent compressibility of the hydraulic fluid that always exists but is relatively minimal. These air bubbles can make their way bit by bit, for example, into a hydraulic fluid feed channel ahead of its respective coupling element when the internal combustion engine is shut off and the channel is idle, even if the corresponding switchable valve, or a check valve, prevents backflow out of the channel. After starting the internal combustion engine, this channel must be bled long enough prior to the first switch command until any amounts of air are removed from it, or at least most of it is. However, there are always areas in this channel that are at geodetically high relative points or at the end of the channel, for example directly in front of the corresponding coupling element, that despite everything are not affected by the bleed stream produced in the channel by the pump-channel connection effected by the switchable valve. A person trained in the art could of course install bypasses around the switchable valve, for example, in order to produce a permanent bleed stream, or to define blow down or leakage points, but this unnecessarily increases the design effort and the costs associated with the hydraulic system and with the overall internal combustion engine.

Also, the hydraulic fluid used can foam up, for example when the internal combustion engine is at hot idle. This foaming can also lead to the undesired hydraulic fluid compressibility mentioned. In worst case, after issuing the switch command, no switching occurs at all at the coupling element since all that occurs is the compression of air or oil foam. Here, as well, a permanent bleed stream could be used to remove the undesired air as much as possible from the corresponding coupling channel when the hydraulic fluid is disconnected. However, as mentioned, this bleed stream does not reach the entire range of the channel up to directly in front of the coupling element, resulting in this air cushion merely being pushed back and forth in the channel between coupling cycles.

SUMMARY

The object of this invention is thus to create a hydraulic system of the above type in which the disadvantages cited are remedied using simple means.

According to the invention, this object is met by providing the path with a connection to a second hydraulic fluid channel at least near the coupling element. This second channel feeds high-pressure hydraulic fluid when the switching pressure is shut off in the first channel, the pressure in the second channel being less than the necessary switching pressure.

Useful embodiments of the invention are discussed below, which can also include independently protectable features.

At this point, it is stressed that the area of protection of the invention refers in particular to a hydraulic system of an internal combustion engine and here especially to a hydraulic system to actuate a coupling element for a slide coupling of a switchable valve driver. However, the concept of the invention goes so far as to include a multitude of hydraulic systems in the design of engines, as well as in other technologies where a slide valve or similar element is to be hydraulically shifted. For example, the invention can also be used for block pistons or slide valves in hydraulic camshaft positioning devices. Also, the area of protection does not extend only to valve drive elements that are installed in slots or bore holes in internal combustion engines, but for example can also extend to finger levers, valve rockers or rocker arms next to one another that can be coupled together selectively using at least one hydraulically moving slide coupling.

According to the invention, by producing a connection to a second high-pressure channel directly in front of the coupling element or its path in the valve drive element, the first channel can be completely or almost completely bled free of air bubbles during the critical times described above, at least while the coupling pressure in the first channel is disconnected. It is helpful in the process to keep this "bleed pressure" to a minimum so as to prevent it from moving the coupling elements in their movement direction. This measure can be implemented extremely inexpensively, for example by means of a simple notch in the valve drive element, as illustrated below in more detail.

Although it is not required, it is expedient to make use of a second channel that supplies a hydraulic play-equalization element in the valve drive element. It is however possible to use separate controls as well.

In this manner, the connection from the second channel to the path directly in front of the side of the coupling element or directly near the side of the coupling element is created by means of a pressure-reducing design such as anozzle or a throttle. This allows the full hydraulic fluid pressure, which is used to actuate the hydraulic play-equalization element to be turned on since only a single hydraulic fluid pump is used, which is an advantage. This is because directly in front of the path or coupling element, the pressure is reduced.

If a person skilled in the art is able to place the connection between the second and the first channel directly behind the side of the coupling element, the best success can be expected according to the invention.

Instead of the suggested nozzle or throttling device, there are other pressure-reducing measures that are already available to the person trained in the art.

According to an additional embodiments of the invention, the hydraulic system can be applied to a hydraulic flat tappet. Here, the "bleed pressure" should pass from a supply chamber in the flat tappets fed from the second channel to a supply chamber in the flat tappets fed from the first channel. In this manner, a transfer line can be implemented at an edge region at the bottom of a slot for the coupling means in the flat tappet, it being useful to locate said slot near the base (but not necessarily).

Another preferred embodiment of the invention relates to a hydraulic system of a roller tappet or similar device. Here, the connection can be produced as an axial path that leads from the second channel at the bore hole in the internal combustion engine to the path in front of the coupling element.

BRIEF DESCRIPTION OF THE DRAWINGS

A preferred embodiment of invention will be explained in detail below with reference to the drawings. In the drawings.

DETAILED DESCRIPTION OF THE PREFERRED EMBODIMENTS

Figure 1:
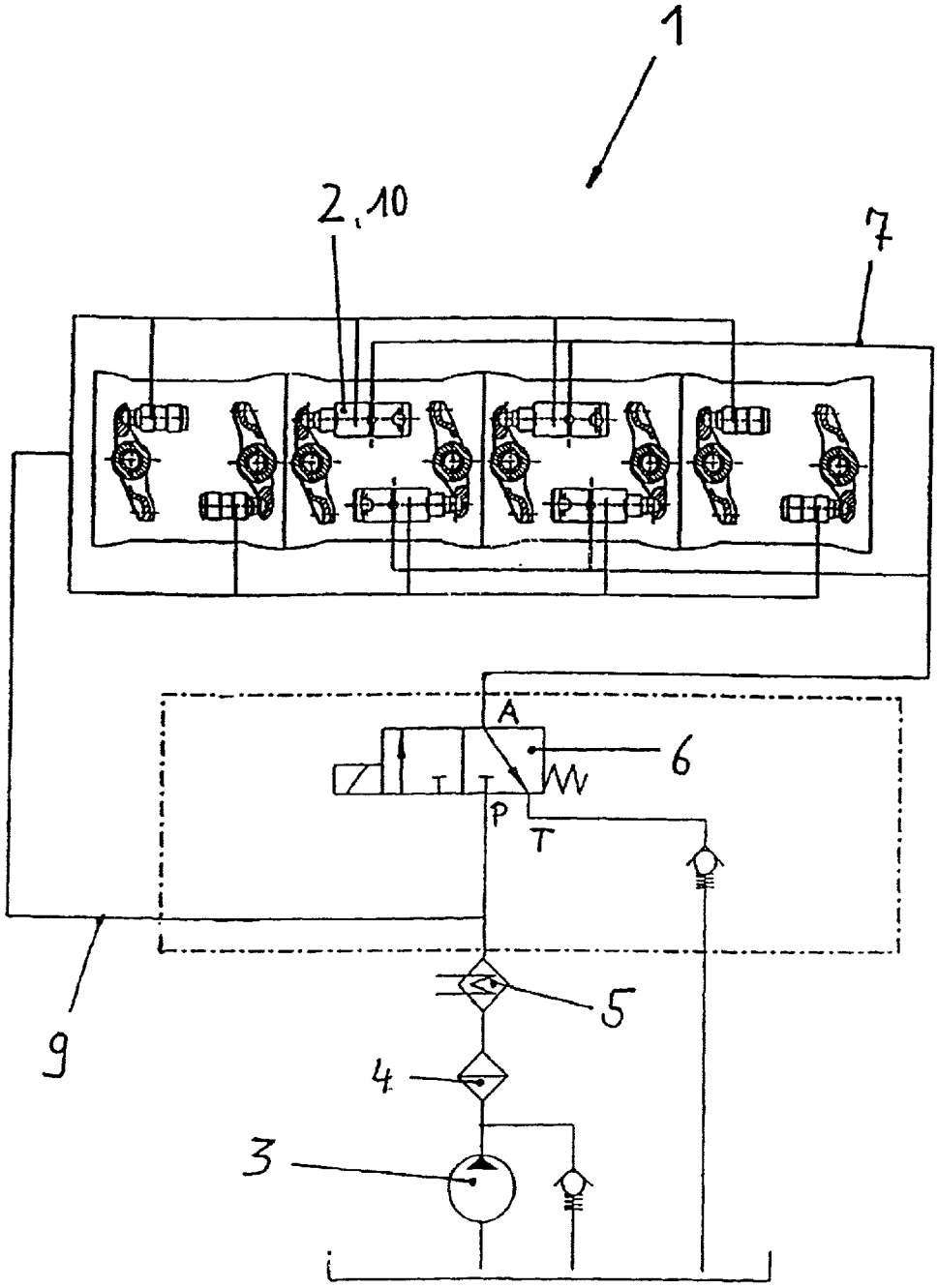
FIG. 1 is a schematic view of a hydraulic system in accordance with the invention.

FIG. 1 discloses in a schematic view a hydraulic system 1 that in this case is used in the supply of switchable support elements 2. A hydraulic fluid pump 3 is shown, downstream of which are essentially an oil filter 4, an oil cooler 5 and a directional valve 6 (here a 3/2 design). A first channel 7 to feed switchable hydraulic fluid pressure to coupling elements 8 (see FIGS. 2–4) connects to a working connection of the directional valve 6 identified by A. The directional valve 6 also has a tank connection T and a pump connection P. A second hydraulic fluid channel 9 branches off just in front of the pump connection P, and supplies hydraulic fluid pressure to a hydraulic play-compensation element 11 located in each of the valve drive elements 10, regardless of the switch position of the directional valve 6.

The directional valve 6 according to FIG. 1is shown in a switch position in which the pressurized hydraulic fluid is disconnected from the first channel 7, which is then connected to the tank connection T. In the second channel 9, there is permanent hydraulic fluid pressure supplying the play-compensation elements 11.

As illustrated in the introductory description, air bubbles can accumulate or oil foaming can occur in the first channel 7. It is clear that the air bubbles tend to collect at high points geodetically. According to this invention, the air bubbles are completely, or almost completely, eliminated from the entire first channel 7 by means of a technically simple measure that is inexpensive to implement. This channel 7 runs from one side 12 (see FIGS. 2–4) of the coupling elements 8 to the pump connection A. This does a good job of eliminating the delays in switching time that are caused by the air bubbles or at least reduces them to a large degree, as is described in more detail below.

According to the invention, this result is accomplished by the entire first channel 7 being bled, when it is disconnected, by the second channel 9 directly at the coupling element 8 itself, namely beginning on its side 12. This is accomplished by means of a connection 13 directly "on the spot", according to the invention, that throttles the pressure in the second channel 9. Of course, it is conceivable to instead run a separate hydraulic fluid line directly to the side 12 of the coupling element 8 and to not directly use the fluid that is used to supply the hydraulic play-compensation element 11.

Figures 2A, 2B, 3, 4:
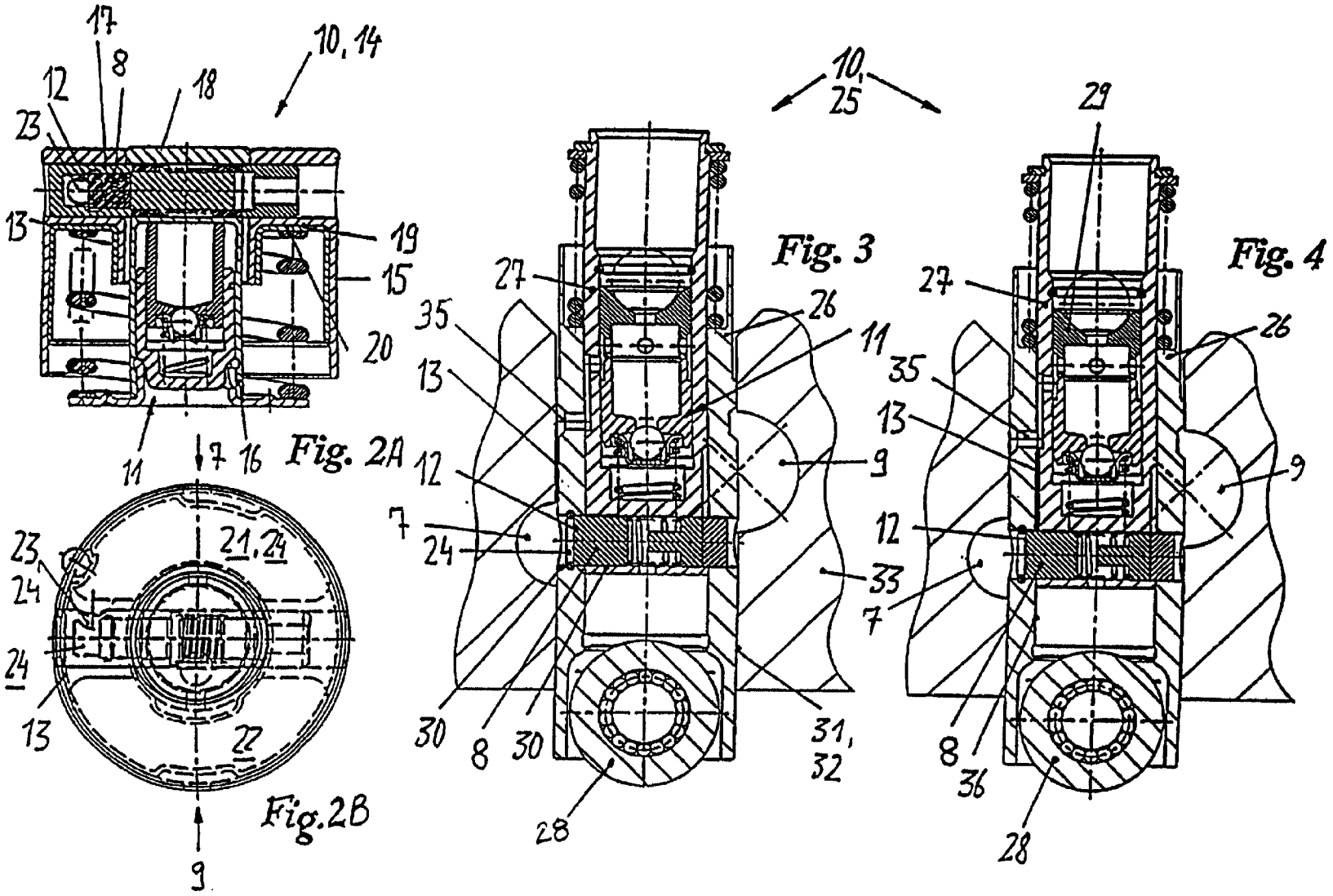
FIG. 2A is a cross-sectional view of a flat tappet in accordance with the invention.
FIG. 2B is a bottom view of the tappet of FIG. 2A for use in the hydraulic system according to FIG. 1.
FIG. 3 is a cross-sectional view of a cam following tappet in accordance with the invention for use in the hydraulic system according to FIG. 1.
FIG. 4 is a cross-sectional view of another embodiment of a cam following tappet in accordance with the invention for use in the hydraulic system according to FIG. 1.

FIGS. 2 through 4 disclose valve drive elements 10 for which the above-mentioned connection 13 has been implemented. FIGS. 2A and 2B show a known switchable flat tappet 14. One part 15 is made in the form of an annular section and another part 16 is made as a round section. The other part 16 is held within the first part 15 telescopically and moves axially with respect to it. The coupling element 8 here moves in a radial slot 17 near a base 18. At a bottom 19 of the slot 17, opposite the base 18, is an annular section 20. This sets off, together with the base 18, one supply chamber 21, 22 on each side of the slot 17 for hydraulic fluid. Supply chamber 21 is fed from the first channel 7. The other supply chamber 22 is connected to the hydraulic fluid from the second channel 9 and is used to supply the hydraulic play-compensation element 11 installed in the other part 16. One supply chamber 21 is provided to actuate the coupling element 8. To this end, the slot 17 has an orthogonal transfer line 23. This is a component of a path 24 within the flat tappet 14 to feed the switching hydraulic fluid pressure from the first channel 7 and the first supply chamber 21.

The connection 13 according to the invention is made here at the bottom 19 of the slot 17. It runs between the annular section 20 and the slot 17 directly in the outer radial edge. In this way, the hydraulic fluid pressure present in the other supply chamber 22 through the second channel 9, the purpose of which is to supply the play-equalization element 11, can be fed to the supply chamber 21 through the connection 13 when the hydraulic fluid pressure is disconnected in the first channel 7. The connection 13 is designed as a throttle so that the full hydraulic fluid pressure is not applied, thus shifting the coupling means 8 in worst case. Air bubbles etc, are thus bled as much as possible from the first supply chamber 21 near side 12 into the first channel 7, which also can contain air bubbles, and go from there out into the open.

FIGS. 3 and 4 disclose a valve drive element 10 that is shown as a cam-following tappet 25. Its one part 26 is also made in the form of an annular section that holds the other part 27. The other part 27 is made to move relative to the first part 26 axially. The first part 26 has a cam contact surface 28 that is designed here as a roller. The other part 27 in turn has a seat 29 opposite the cam contact surface 28 for one end of a push rod (not illustrated).

In tappet 25, there is a radial slot 30 that penetrates both parts 26, 27. The coupling element 8 is held in slot 30 of the other part 27 in its decoupled state. The path 24 is thus formed here by the slot 30 in the outer part 26.

The outer surface 31 of the tappet 25 moves inside a bore hole 32 in an internal combustion engine 33. The first channel 7 for the switchable pressurized hydraulic fluid is placed radially outside in front of path 24, which is directly adjacent to the side 12 of the coupling means 8. The second channel 9 leads to a bore hole 32 at an axial distance away from the first channel 7. This communicates with a radial transfer line 35 on or in part 26. The hydraulic play-equalization element 11 is fed through this radial transfer line 35.

According to FIG. 3, the connection 13 according to the invention is implemented at the outer surface 3 1 of the first part 26. As seen to the left of the symmetrical line in FIG. 3, the connection runs from the radial transfer line 35 directly to the path 24 in front of the coupling element 8. According to FIG. 4, on the other hand, the connection can also be located at an inner surface 36 of the first part 26, starting at the radial transfer line 35, and can run behind the side 12 of the coupling element 8.

| List of Reference Numbers and Letters |
|---|
| 1 Hydraulic System |
| 2 Support Element |
| 3 Hydraulic Fluid Pump |
| 4 Oil Filter |
| 5 Oil Cooler |
| 6 Directional Valve |
| 7 First Channel |
| 8 Coupling Element |
| 9 Second Channel |
| 10 Valve Drive Element |
| 11 Hydraulic Play-Compensation Element |
| 12 Side |
| 13 Connection |
| 14 Flat tappet |
| 15 Part |
| 16 Part |
| 17 Slot |
| 18 Base |
| 19 Bottom |
| 20 Annular section |
| 21 Supply chamber |
| 22 Supply chamber |
| 23 Transfer line |
| 24 Path |
| 25 Tappet |
| 26 Part |
| 27 Part |
| 28 Cam Contact Surface |
| 29 Seat |
| 30 Slot |
| 31 Outer surface |
| 32 Bore Hole |
| 33 Internal Combustion engine |
| 35 Radial Transfer line |
| 36 Inner Surface |
| A Working connection |
| P Pump Connection |
| T Tank Connection |

What is claimed is:

1. A hydraulic system for an internal combustion engine with at least one hydraulically actuated coupling element comprising a slide coupling in a switchable valve drive element, the valve drive element including at least two parts that move with respect to one another to attain different cam strokes, wherein on at least one side of the coupling element a path extends in or on the valve drive element to feed switching hydraulic fluid pressure, the valve drive element moving within a bore hole in the internal combustion engine into which a first channel opens to feed the switching hydraulic fluid pressure, one end of the channel being supplied by a hydraulic fluid pump followed by a directional valve to turn on and turn off the switching pressure, and an other end of the channel being hydraulically connected to the path, wherein the path is provided with a connection to a second hydraulic fluid channel at least near the coupling element, the second channel feeding high-pressure hydraulic fluid at least when the switching pressure is shut off in the first channel, the hydraulic fluid pressure in the second channel being less than a necessary switching pressure.

2. The hydraulic system according to claim 1, wherein the connection comprises a pressure-reducer.

3. The hydraulic system according to claim 1, wherein the second channel is also supplied by the same hydraulic fluid pump and is supplied by a connection prior to the directional valve as seen in a flow direction.

4. The hydraulic system according to claim 1, wherein a hydraulic play-compensation element is installed in the valve drive element and is supplied by the second channel.

5. The hydraulic system according to claim 4, wherein the valve drive element comprises a hydraulic flat tappet having one part with an annular section and another part with a round section that holds the play-compensation element, the other part being held within the first part telescopically and moving axially with respect to it, wherein the coupling element is located in a radial or secant slot in the flat tappet, wherein at a bottom of the slot opposite a base of the flat tappet is an annular section that sets off, together with the slot and at least a component of the base, one supply chamber on each side for the hydraulic fluid, wherein the one supply chamber is fed from the first channel and the other supply chamber is fed from the second channel through the bore hole in the internal combustion engine, wherein the first supply chamber is a component of the path and has an orthogonal transfer line behind the side of the respective coupling element through the slot and wherein the connection between the supply chambers is produced between the bottom of the slot and the annular section.

6. The hydraulic system according to claim 5, wherein the connection is implemented in an area of the transfer line.

7. The hydraulic system according to claim 4, wherein the valve drive element comprises a cam-following tappet in a push rod drive, a first part of which has an annular section with a cam contact surface and an other part has a round section containing the play-compensation element, the other part being held in the first part and moves axially, telescopically relative to it, wherein there is a radial or secant slot in the parts for the hydraulic fluid in which the outer radial side of the coupling element slides out of the slot in the first part and into the slot in the other part in its decoupled state, wherein the path is formed by the slot of the first part and communicates directly with the first channel at a radial exterior at the bore hole of the internal combustion engine, wherein the second channel opens to the bore hole at an axial distance away from the first channel, the second channel being hydraulically connected to the play-compensation element in the first part via a radial transfer line, and wherein the connection is produced either at an outer or inner surface of the first part or in the bore hole of the internal combustion engine by a longitudinal or spiral path from the radial transfer line and an end of the second channel to the path.

8. The hydraulic system according to claim 2, wherein the pressure-reducer is one of a nozzle and a throttle.

* * * * *